US006589016B2

(12) United States Patent
Boyd et al.

(10) Patent No.: US 6,589,016 B2
(45) **Date of Patent: *Jul. 8, 2003**

(54) LOW SPEED COOLING FAN

(75) Inventors: Walter K. Boyd, Riverside, CA (US); William C. Fairbank, Riverside, CA (US)

(73) Assignees: Mechanization Systems Co., Inc., Colton, CA (US); Delta T. Corporation, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/881,646

(22) Filed: Jun. 12, 2001

(65) Prior Publication Data

US 2002/0001521 A1 Jan. 3, 2002

Related U.S. Application Data

(63) Continuation of application No. 09/253,589, filed on Feb. 19, 1999, now Pat. No. 6,244,821.

(51) Int. Cl.[7] ..... B64C 11/00
(52) U.S. Cl. ..... 416/1; 416/244 R; 29/156.8
(58) Field of Search ..... 416/210 R, 223 R, 416/244 R, 238, 189, 5, 1; 29/156.8; 454/292

(56) References Cited

U.S. PATENT DOCUMENTS

| | | | | |
|---|---|---|---|---|
| 399,973 A | | 3/1889 | Cassidy | |
| 681,710 A | | 9/1901 | Kemmerer | |
| 921,744 A | | 5/1909 | Scott | |
| 1,642,205 A | | 9/1927 | Hosch | |
| 2,736,137 A | | 2/1956 | Thaheld | |
| 3,051,072 A | | 8/1962 | Bohanon | |
| 3,689,971 A | | 9/1972 | Davidson | |
| 3,768,546 A | | 10/1973 | Shipes | |
| 3,818,813 A | | 6/1974 | Freeman | |
| 4,008,007 A | | 2/1977 | Shipes | |
| 4,181,690 A | | 1/1980 | Neu | |
| 4,202,655 A | | 5/1980 | Maloof | |
| 4,275,993 A | | 6/1981 | Sprengling | |
| 4,373,241 A | * | 2/1983 | Maloof | 416/223 A |
| 4,779,671 A | | 10/1988 | Dolison | |
| 4,892,460 A | | 1/1990 | Volk | |
| 5,246,343 A | | 9/1993 | Windsor et al. | |
| 5,328,329 A | | 7/1994 | Monroe | |
| 5,542,819 A | | 8/1996 | Bucher et al. | |
| 5,567,200 A | | 10/1996 | Swartzendruber | |
| 5,795,220 A | * | 8/1998 | Core | 454/292 |
| 5,860,788 A | * | 1/1999 | Sorensen | 416/189 |
| 6,039,541 A | | 3/2000 | Parker et al. | |
| 6,244,821 B1 | * | 6/2001 | Boyd et al. | 416/210 R |

* cited by examiner

*Primary Examiner*—Edward K. Look
*Assistant Examiner*—James M. McAleenan
(74) *Attorney, Agent, or Firm*—Knobbe, Martens, Olson & Bear, LLP

(57) ABSTRACT

A low speed cooling fan that is designed to cool individuals located in large industrial buildings. A fan with a diameter between 15 to 40 feet consisting of a plurality of blades, with each in the shape of a tapered airfoil, is driven by an electric motor to produce a very large slowly moving column of air. The moving column of air creates a uniformly gentle circulatory airflow pattern throughout the interior of the building thus promoting the natural evaporative cooling process of the human body at all locations inside the building.

14 Claims, 11 Drawing Sheets

LOW SPEED COOLING FAN

RELATED APPLICATIONS

This application is a continuation of U.S. patent application Ser. No. 09/253,589, filed on Feb. 19, 1999 now U.S. Pat. No. 6,244,821, entitled "Low Speed Cooling Fan."

BACKGROUND OF THE INVENTION

1. Field of the Invention

The present invention relates to cooling devices in large buildings and, in particular, concerns a large diameter low speed fan that can be used to slowly circulate a large volume of air in a uniform manner throughout a building so as to facilitate cooling of individuals or animals located in the building.

2. Description of the Related Art

People who work in large structures such as warehouses and manufacturing plants are routinely exposed to working conditions that range from being uncomfortable to hazardous. On a hot day, the inside air temperature can reach a point where a person is unable to maintain a healthy body temperature. Moreover, many activities that occur in these environments, such as welding or operating internal combustion engines, create airborne contaminants that can be deleterious to those exposed. The effects of airborne contaminants are magnified to an even greater extent if the area is not properly vented.

The problem of cooling large structures cannot always be solved using conventional air-conditioning methods. In particular, the large volume of air that is enclosed within a large structure would require powerful air conditioning devices to be effective. If such devices were used, the operating costs would be substantial. The cost of operating large air conditioning devices would be even greater if large doors where routinely left in an open state or if ventilation of outside air was required.

In general, fans are commonly used to provide some degree of cooling when air conditioning is not feasible. A typical fan consists of a plurality of pitched blades radially positioned on a rotatable hub. The tip-to-tip diameter of such fans typically range from 3 feet up to 5 feet.

When a typical fan rotates under the influence of a motor at higher rotational speeds, a pressure differential is created between the air near the fan blades and the surrounding air, causing a generally conical flow of air that is directed along the fan's axis of rotation. The conical shape combined with drag forces acting at the boundary of the moving mass of air cause the airflow pattern to flare out in a diffusive manner at downstream locations. As a consequence, the ability of these types of fans to provide effective and efficient cooling can be limited for individuals located at a distance from the fan.

In particular, the effectiveness of a fan is based on the principle of evaporation. When the temperature of a human body increases beyond a threshold level, the body responds by perspiring. Through the process of evaporation, the more energetic molecules comprising the perspiration are released into the surrounding air, thus resulting in an overall decrease in the thermal energy of the exterior of the individual's body. The decrease in thermal energy due to evaporation serves to offset positive sources of thermal energy in the individual's body including metabolic activity and heat conduction with surrounding high temperature air.

The rate of evaporative heat loss is highly dependent on the relative humidity of the surrounding air. If the surrounding air is motionless, then a layer of saturated air usually forms near the surface of the individual's skin which dramatically decreases the rate of evaporative heat loss as it prevents the evaporation from the individual's body. At this point, perspiration builds up causing the body to break out into a sweat. The lack of an effective heat loss mechanism results in the body temperature increasing beyond a desired level.

The airflow created by a fan helps to break up the saturated air near the surface of a person's skin and replace it with unsaturated air. This effectively allows the process of evaporation to continue for extended periods of time. The desired result is that the body temperature remains at a comfortable level.

In large buildings, the conventional strategy for cooling individuals has been to employ many commonly available small diameter indoor fans. Small diameter fans have been favored over large diameter fans primarily because of physical constraints. In particular, large diameter fans require specially constructed high-strength light-weight blades that can withstand large stresses caused by significant gravitational moments that increase with an increasing blade length to width aspect ratio. In addition, the fact that the rotational inertia of the fan increases with the square of the diameter requires the use of high torque producing gear reduction mechanisms. Moreover, drive-train components are highly susceptible to mechanical failure due to the very large torques produced by conventional electric motors during their startup phase.

A drawback of using a conventional small diameter fan to create a continuous flow of air is that the resulting airflow dramatically decreases at downstream locations. This is due to the conical nature of the airflow combined with the relatively small mass of air that is contained in the airflow in comparison to resistive drag forces acting at the edge of the cone. To achieve a sufficient airflow in a large non-insulated building, a very large number of small diameter fans would be required. However, the large amount of electrical power required by the simultaneous use of these devices in great numbers negates their advantage as an inexpensive cooling system. Moreover, the use of many fans in an enclosed space can also result in increased air turbulence that can actually decrease the air flow in the building thereby decreasing the cooling effect of the fan.

To achieve a sufficient airflow in large buildings without relying on an impractically large number of small diameter fans, a small number of small diameter fans are typically operated at very high speeds. However, although these types of fans are capable of displacing a large amount of air in a relatively small amount of time, they do so in an undesirable manner. In particular, a small high speed fan operates by moving a relatively small amount of air at a relatively high speed. Consequently, the speed of the airflow adjacent the fan and the level of noise produced are both very high. Furthermore, lighter weight objects, such as papers, may get displaced by the high speed air flow, thus causing a major disruption to the work environment.

Another problem with high speed fans is that they are inefficient at entraining a large enclosed volume of air in a steady continuous airflow pattern. In particular, assuming a best case scenario of laminar airflow, the power consumption of a fan is proportional to the cube of the airspeed produced by the fan. Consequently, an electrically driven high speed fan having a corresponding high speed airflow consumes electrical power at a relatively large rate. Furthermore, the effects of turbulence, which become more pronounced as the speed of the airflow increases, cause the translational kinetic energy associated with the airflow of a high speed fan to be dissipated within a relatively small volume of air. Consequently, even though a relatively large amount of electrical power is consumed by the high speed fan, negligible airflows are produced at locations that are distant from the fan.

To overcome insufficient airflow problems, larger numbers of high speed fans are sometimes used. However, this solution increases the ambient noise and operating costs even further. In addition, regions of fast moving air are expanded, thus increasing the risk of injury to exposed individuals. In particular, if the air is moving fast enough, foreign objects can become airborne, thus causing a hazardous situation. Papers and other light objects can also be greatly effected. Moreover, if the air temperature is above the skin temperature of an individual, then air moving faster than what is needed to break up the boundary layer actually reduces the cooling effect due to the increased rate of heat flow from the higher temperature air to the lower temperature skin of the individual.

In addition to cooling, fans are also relied upon in ventilation systems that serve to remove airborne contaminants such as exhaust or smoke. Typical ventilation systems consist of a set of high speed fans located at the perimeter of the structure. However, the previously mentioned problems of high speed fans apply to high speed ventilation fans. The most serious problem is that some areas inside the structure are not properly ventilated.

To improve ventilation, high speed indoor fans are sometimes used to distribute contaminants throughout the entire volume of a structure. However, the same limitations of high speed indoor fan systems described earlier apply to the problem of ventilation. In particular, high speed indoor fans are loud, inefficient, provide an insufficient airflow to some regions, and provide an undesirably large airflow to others.

From the foregoing, it will be appreciated that there is a need for a cost efficient cooling device that can be effectively operated in large buildings. Furthermore, there is a need for such a device that is very efficient and does not disrupt the work environment with excessive noise or high speed airflows. Furthermore, there is a need for such a device that will dilute concentrated pockets of contaminated air contained within the structure more uniformly, thus providing optimal ventilation to the structure when used in conjunction with a conventional ventilation system.

SUMMARY OF THE INVENTION

The aforementioned needs are satisfied by the method of the present invention, the method in one embodiment comprising mounting a fan having a plurality of blades that are at least approximately 10 to 12 feet in length to a ceiling of the industrial building and rotating the fan so as to produce a moving column of air that is approximately 20 to 24 feet in diameter at a position adjacent the fan. In one embodiment, the rotation of the fan imparts a velocity of approximately 3 mph to 5 mph at a distance of 10 feet from the fan so that the fan entrains a volume of air to flow in a pattern throughout the industrial building so that the entrained air in the pattern disrupts the boundary layer of air adjacent the individuals so as to facilitate evaporation of sweat from the individual.

In one embodiment, the step of mounting the fan comprises mounting a plurality of fans having a plurality of blades of approximately 10 feet in length to the ceiling of the industrial building wherein the ratio of such fans per square foot of building is approximately 1 fan per 10,000 square feet. In another embodiment, the step of rotating the fan so as to entrain the volume of air to flow in the pattern comprises entraining the air to flow in a column generally downward towards the floor of the building and then to travel laterally outward from the column.

In another aspect of the invention, the aforementioned needs are satisfied by the fan assembly of the present invention which is comprised of a support, a motor, a hub, and a plurality of fan blades. The support is adapted to allow the mounting of the fan assembly to the roof of the industrial building. The motor is coupled to the support and is engaged with a rotatable shaft so as to induce rotation of the shaft. The plurality of fan blades are attached to the rotatable shaft and are approximately 10 feet in length and have an airfoil cross-section. The motor is adapted to rotate the fan blades at approximately 50 rotations per minute so that the plurality of fan blades produce a column of moving air that is approximately 20 feet in diameter at a position immediately adjacent the fan blades. In one embodiment, there are 10-foot blades that are rotated at an rpm such that the ratio of the velocity of the air in feet per minutes at a distance of approximately ten feet from the blades to the rpm is between the approximate range of 5 to 1 and 9 to 1 so that a moving volume of air is entrained in flow in a circulating pattern throughout the industrial building to thereby disrupt the boundary layer of air adjacent the individuals so as to facilitate evaporation of sweat from the individual.

From the foregoing, it should be apparent that the fan assembly of the present invention provides a quiet and cost-efficient way of cooling individuals in large non-insulated structures. The fan assembly of the present inventions effectiveness is based on its ability to provide a gentle yet steady airflow throughout the interior of the structure with minimal expenditure of mechanical energy. As a consequence, the fan assembly of the present invention dilutes concentrated pockets of air contaminants which helps to maintain breathable air throughout the interior of the structure. These and other objects and advantages of the present invention will become more apparent from the following description taken in conjunction with the accompanying drawings.

DETAILED DESCRIPTION OF THE PREFERRED EMBODIMENT

Figure 1:
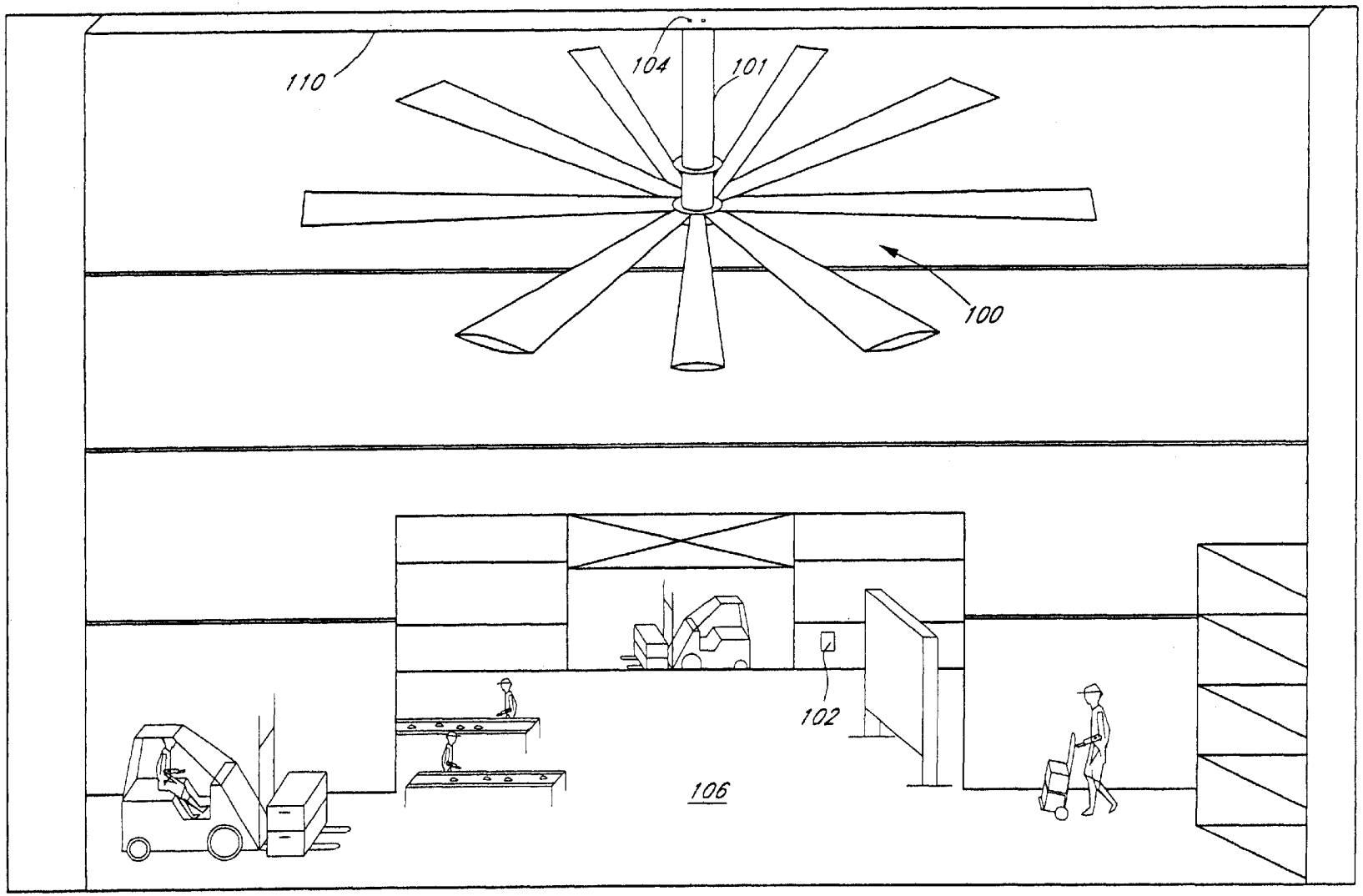
FIG. 1 is a perspective view of a low speed cooling fan assembly of the present invention illustrating the positioning of the fan adjacent to the ceiling of a large commercial building.

Reference will now be made to the drawings wherein like numerals refer to like parts throughout. FIG. 1 shows a low speed fan assembly 100 of the preferred embodiment in a typical warehouse or industrial building configuration. The low speed fan assembly 100 can be attached directly to any suitable preexisting supporting structure or to any suitable extension connected thereto such that the axis of rotation of the low speed fan assembly 100 is along a vertical direction. FIG. 1 shows the low speed fan assembly 100 attached to an extension piece 101 which is attached to a mounting location 104 located on a warehouse ceiling 110 using conventional fasteners, such as nuts, bolts and welds, known in the art.

A control box 102 is connected to the low speed fan assembly 100 through a standard power transmission line. The purpose of the control box 102 is to supply electrical energy to the low speed fan assembly 100 in a manner which is further described in a following section. As shown in FIG. 1, the low speed fan assembly 100 is mounted high above the floor 105 of an industrial building so that the fan 100 can cool the occupants of the building. As will be described in greater detail below, the low speed fan assembly 100 is very large in size and is capable of generating a large mass of moving air such that a large column of relatively slow moving air is entrained to travel throughout the facility to cool the occupants of the facility.

Figure 2:
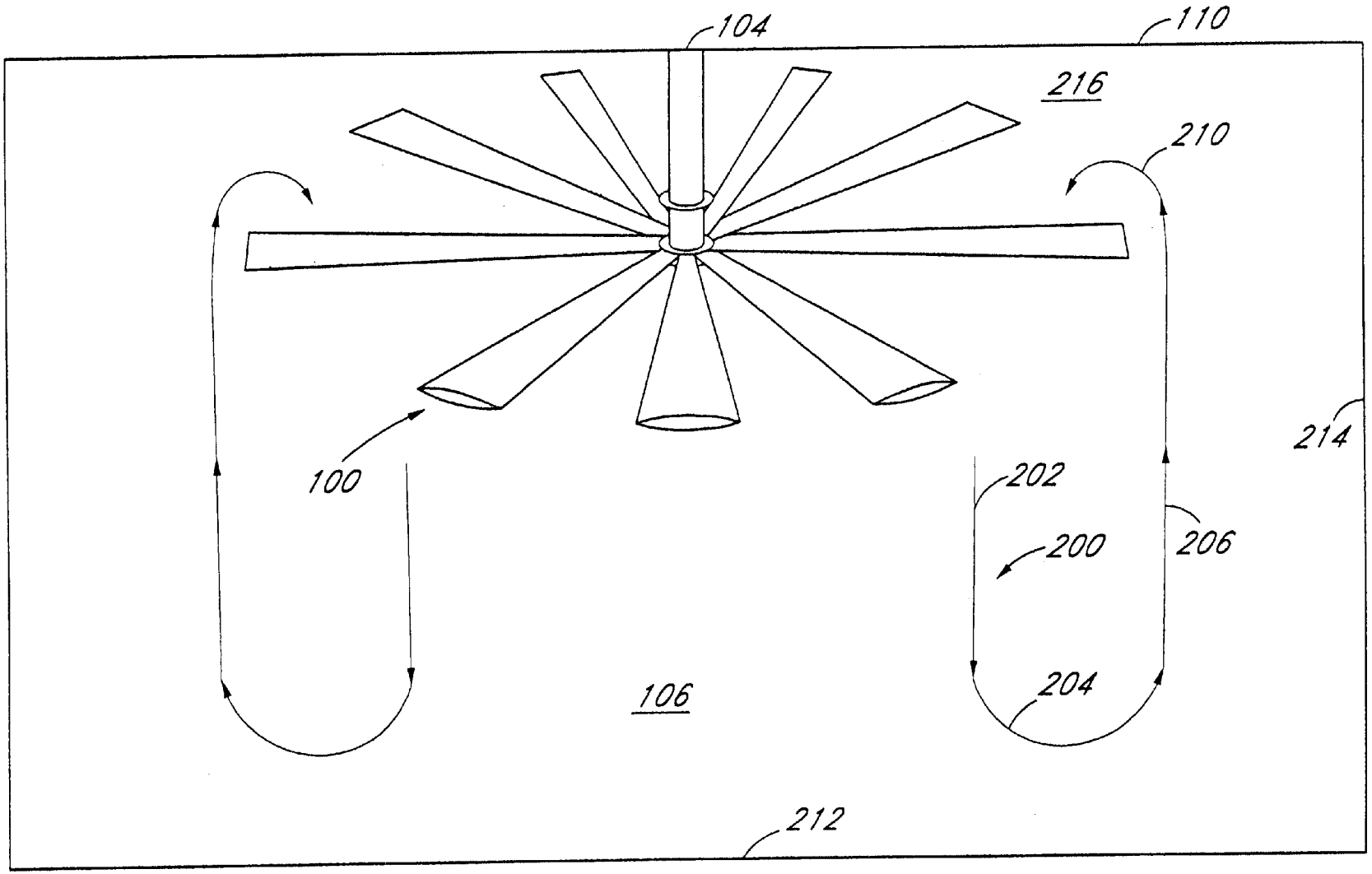
FIG. 2 is a perspective view that illustrates the airflow pattern created by the low speed cooling fan assembly of FIG. 1.

In particular, as shown in FIG. 2, when a user places the low speed fan assembly 100 into an operational mode by entering appropriate input into the control box 102, a uniform gentle circulatory airflow 200 (FIG. 2) is formed throughout the building interior 106. In a general sense, the circulatory airflow 200 begins as a large relatively slowly moving downward airflow 202. The airflow 202 is able to travel through vast open spaces due to its large amount of inertial mass and because it travels away from the fan assembly 100 in a columnar manner as will be described in greater detail in a following section. Consequently, the airflow 202 approaches a floor area 212 located beneath the fan assembly 100 largely unimpeded with a large amount of inertial mass.

Upon reaching the floor area 212, the airflow 202 subsequently becomes an outwardly moving lower horizontal airflow 204. The lower horizontal air flow 204 is directed by the walls 214 of the warehouse into an upward airflow 206 which is further directed by the warehouse ceiling 110 into an upper inwardly moving horizontal airflow 210. Upon reaching a region 216 above the fan assembly 100, the returning air in airflow 210 is directed downward again by the action of the fan assembly 100, thus repeating the cycle.

The continuously circulating airflow 200 created by the fan assembly 100 provides a more pleasant working environment for individuals working inside the warehouse interior 106. As discussed above, in warm environments, the occupants begin to sweat, creating a moisture laden boundary layer adjacent the occupant's skin. With no airflow, the boundary layer is not disrupted which inhibits further evaporation of the occupant's sweat. The airflow 200 provides relief to the occupant by replacing the moisture laden air near the skin of individuals with unsaturated air thereby allowing more evaporative cooling to take place. Furthermore, the circulatory airflow 200 created by the fan assembly 100 significantly reduces the deleterious effects of airborne contaminants by uniformly distributing the contaminants throughout the warehouse interior. Moreover, the fan assembly 100 produces a very low volume of noise and its associated circulatory airflow 200 is minimally disruptive to the work environment. It will be appreciated from the following discussion that the fan assembly 100 is able to provide these benefits in a very cost effective manner.

Figure 3A:
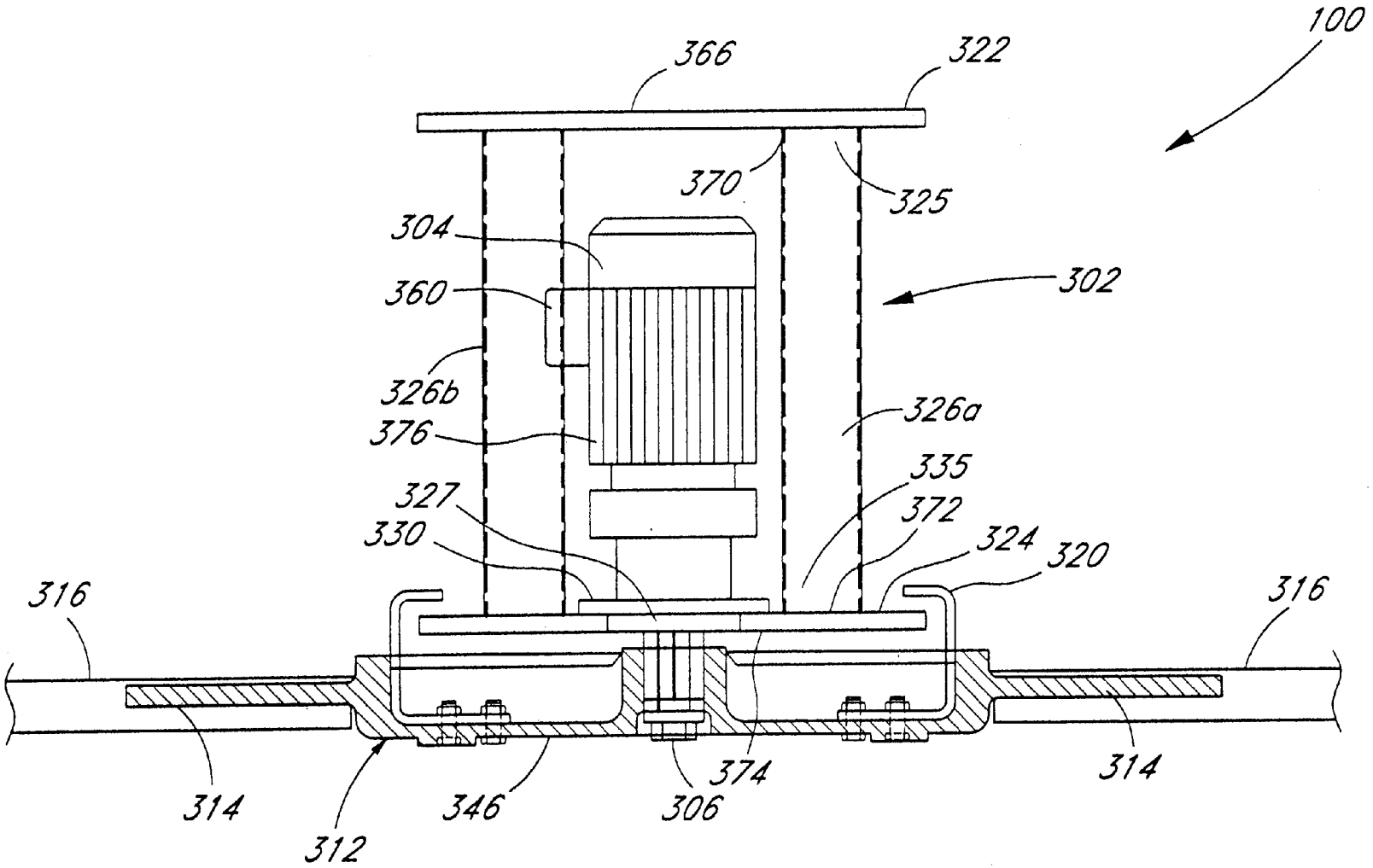
FIG. 3A is a side elevation view of the low speed cooling fan assembly of FIG. 1.
Figure 3B:
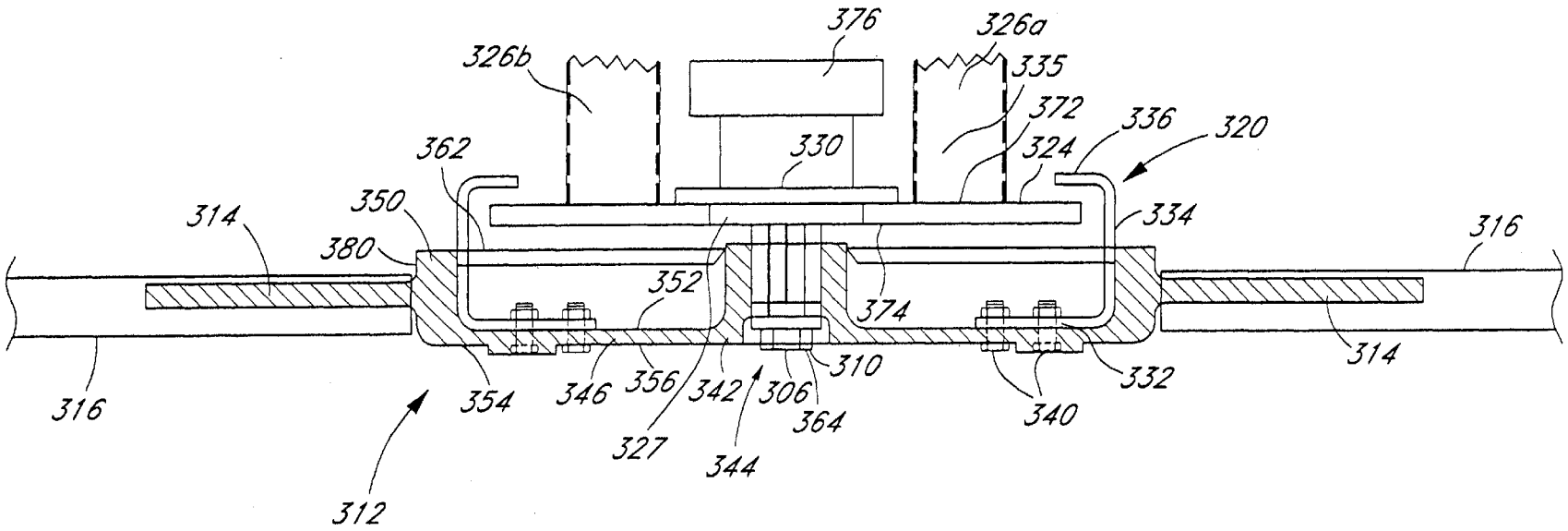
FIG. 3B is a magnified side elevation view of the lower section of the low speed cooling fan assembly of FIG. 1.

The low speed fan assembly 100 will now be described in more detail in reference to FIGS. 3 through 11 hereinbelow. FIG. 3A shows a detailed side elevation view of the low speed fan assembly 100. FIG. 3B is a magnified side elevation view of the fan assembly 100 that illustrates the lower section in greater detail.

The fan assembly 100 receives mechanical support from a support frame 302. The support frame 302 includes an upper steel horizontal plate 322 that is adapted to attach to a suitable horizontal support structure adjacent to a ceiling of the building such that contact is made between the support structure and a first surface 366 of plate 322 to thereby allow the fan assembly 100 to be mounted adjacent the ceiling. In one embodiment, the plate 322 is bolted to a ceiling support girder so that the fan assembly 100 extends downward from the ceiling of the building in the manner similar to that shown in FIG. 1.

A first end 325 of each of a pair of support beams 326*a*, 326*b* are welded a second surface 370 of plate 322 so as to extend in a direction that is perpendicular to the plane of the plate 322. A lower steel horizontal plate 324 is welded to a second end 335 of the support beams 326*a*, 326*b* along a first surface 372 of plate 324 so that the plane of the second horizontal plate 324 is perpendicular to the axis of the support beams 326*a*, 326*b*. The second horizontal plate 324 contains an opening 327 that allows an electric motor 304 having a housing 376 to be mounted inside the frame 302 adjacent the surface 372 of the plate 324. This allows a shaft 306 of the electric motor 304 that extends from the electric motor housing 376 to extend through the opening 327 so as to be adjacent a second surface 374 of the plate 324.

Electrical power is transferred from the control box 102 to the electric motor 304 along a standard power transmission line through a junction box 360 located on the upper perimeter of housing 376 of the electric motor 304. The motor assembly also includes a mounting plate 330 that is a round annular steel plate that is integrally attached to the housing 376 adjacent the shaft 306 and lies in a plane that is perpendicular to the shaft 306. The mounting plate 330 is interposed between the motor housing 376 and the second support plate 324 of the support frame as shown in FIGS. 3A and 3B.

In the preferred embodiment, the electric motor 304 is adapted to receive an AC power source with a varying frequency which allows the electric motor 304 to produce a variable torque. By using an AC device, the use of problematic pole-switching brushes found in DC style motors is avoided. The electric motor 304 further contains a built-in gear reduction mechanism that provides the necessary mechanical advantage to drive the large fan assembly 100. The electric motor 304 used in the preferred embodiment is manufactured by the Sumitomo Machinery Corporation of America and has a model number CNVM-8-4097YA35. The maximum rate of power consumption of the electric motor 304 used in the preferred embodiment is 370 Watts.

In the preferred embodiment, the control box 102 is implemented in the form of an AC power supply with variable frequency control manufactured by Sumitomo Machinery Corporation of America with a model number NT2012-A75. A digital operator interface allows the user to select different operating conditions. For example, the user can select an initial startup by instructing the control box 102 to produce an AC voltage with a gradually increasing frequency so as to prevent the electric motor 304 from damaging the fan assembly 100. In another example, the user can select a maximum continuous speed by instructing the control box 102 to produce an AC voltage with a fixed frequency of 60 Hz. In another example, the user can select a reduced continuous speed by instructing the control box 102 to produce an AC voltage with a fixed frequency less than 60 Hz.

The control box 102 used in the preferred embodiment also provides other advantages. For instance, the control box 102 can be remotely operated by a central control station. Standard analog inputs also allow the device to easily receive control input from thermometers, relative humidity measuring devices, and air speed monitors.

As shown in FIG. 3A, the electric motor 304 is mounted directly to the support frame 302 so as to provide the fan assembly 100 with a driving torque. In particular, a first surface 502 (see FIGS. 5A and 5B) of the mounting plate 330 of the electric motor 304 is positioned adjacent the first surface 372 of the second support plate 324 of the support frame 302 so that the motor shaft 306 extends through the opening 327 of the plate 324. Furthermore, the rotational axis of the electric motor 304, defined by the elongated axis of the motor shaft 306, is oriented so as to be perpendicular to the plane of the plate 324. In addition, a boss member 504 that integrally extends from the first surface 502 of the mounting plate 330 (FIGS. 5A and 5B) is flushly positioned within the opening 327 of the plate 324. As will be described in greater detail below, the mounting plate 330, positioned in the foregoing manner, is secured to the plate 324 with a plurality of fasteners so as to secure the electric motor 304 to the support frame 302.

The motor shaft 306 transfers torque from the electric motor 304 to a hub 312 that is mounted on the shaft 306. The hub 312, in this embodiment, is a single cast aluminum piece of material with a disk-like shape that is adapted to secure a set of fan blades 316. As will be described in greater detail below, the hub 312 is adapted to mount on the motor shaft 306 and provide a mounting location for a plurality of fan blades 316 (see FIG. 6) so that rotation of the motor shaft 306 will result in rotation of the fan blades 316. The hub 312 contains a round flat central section 346 that generally extends radially outward from the shaft 306 so as to define a plane and comprises an inner surface 352 and a parallel outer surface 356 (FIG. 3B).

As shown in FIG. 3B, a cylindrically symmetric flange section 342 extends inwardly from the center of the central section 346 in a direction that is orthogonal to the plane of the central section 346. The flange section 342 defines a cylindrically symmetric opening 344 that is adapted to receive the motor shaft 306 and a locking collet 310. In one embodiment, the collet 310 is manufactured by Fenner Trantorque with a model number 62002280. At an outer region 354 of the central section 346, a symmetric polygonal rim section 350 extends upwardly from the inner surface 352 of the central section 346 in a direction orthogonal to the plane of the central section 346.

A plurality of narrow structural ribs 362 are integrally formed along a radial direction along the inner surface 352 of the central section 346 and join the inner surface 352 to both the flange section 342 and the rim section 350 of the central section 346. Measured from the surface 356 along a direction perpendicular to the surface 356, the heights of the hub 312 at the rim section 350, at the flange section 342, and along any of the structural ribs 362 are, in this embodiment, approximately equal to each other.

A plurality of blade supports 314 extend from an outer surface 380 from the rim section 350 so as to extend radially outward from the axis of rotation defined by the motor shaft 306 by an approximate distance of 15 inches. The support blades 314 have a paddle-like shape and are adapted to slip into the ends of a plurality of fan blades 316 to provide a means for mounting the fan blades 316 to the hub 312. A more thorough discussion of the fan blades 316 including their mounting procedure is provided below.

The hub 312 is placed in a mounting position by orienting the hub 312 in a plane perpendicular to the shaft 306 so that the inner surface 352 is facing in the direction of the electric motor 304. The hub 312 is then positioned so that the shaft 306 extends through the opening 327 of the flange section 342 until the first end 364 of the shaft 306 is approximately coplanar with the outer surface 356 of the central section 346 of the hub 312. With the hub 312 in position, the hub 312 is secured to the shaft 306 using the collet 310 in a manner which is known in the art such that the no slipping occurs between the hub 312 and the motor shaft 306.

A set of safety retainers 320 are used to support the combined weight of the hub 312 and the set of fan blades 316 in an emergency situation. In this embodiment, each safety retainer 320 is essentially a u-shaped piece of high strength aluminum of approximately one inch in width. Each safety retainer 320 is comprised of a straight first section 332, a straight second section 334 that extends orthogonally from the first section 332, and a straight third section 336 that extends orthogonally from the second section to complete the u-like shape of the safety retainer 320.

Each safety retainer 320 is mounted to the hub 312 by positioning the first section 332 along the inner surface 352 of the central section 346 so that the second section 334 is flushly positioned adjacent the rim section 350 of the central section 346. With the first section 332 radially aligned on the inner surface 352, the first section 332 is secured to the central section 346 using a plurality of bolts 340, thus securing the safety retainer 320 to the hub 312.

In a secured state, each safety retainer 320 is adapted so that the third section 336 extends over the second support plate 324 of the support frame 302 by an amount that allows the plurality of safety retainers 320 to independently support the hub 312 in the event that the hub 312 is disengaged from the fan assembly 100. In particular, the third sections 336 of the safety retainers 320 will catch on the first surface 372 of the second support plate 324 in the event that the hub 312 is disengaged from the shaft 306 of the electric motor 304, e.g.

if the collet 310 fails, or in the event that the shaft 306 ruptures. In this way, the safety retainers 320 will prevent the hub 312 and the attached fan blades 316 from falling to the floor below. Moreover, each safety retainer 320 is also adapted in a manner that prevents the third section 336 from coming into contact with the support beams 326*a*, 326*b* and are generally positioned above the first surface 372 of the second support plate 324 when the fan assembly 100 is operating properly.

In the preferred embodiment, four safety retainers 320 are positioned at ninety degrees intervals from each other. If the hub 312 becomes disconnected from the shaft 306 while the fan assembly 100 is mounted in a vertical manner as shown in FIG. 1, then the safety retainers 320 will provide a means of support for the hub 312, thus preventing the hub 312 from falling to the ground.

Figure 4A:
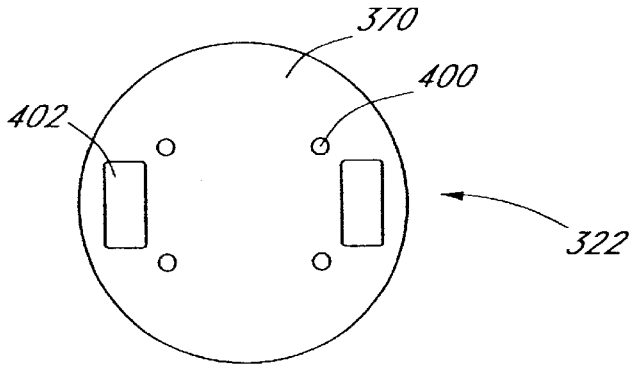
FIG. 4A is a plan view of the first support plate illustrating some of the structural components of the electric motor support frame of the low speed cooling fan assembly of FIG. 1.
Figure 4B:
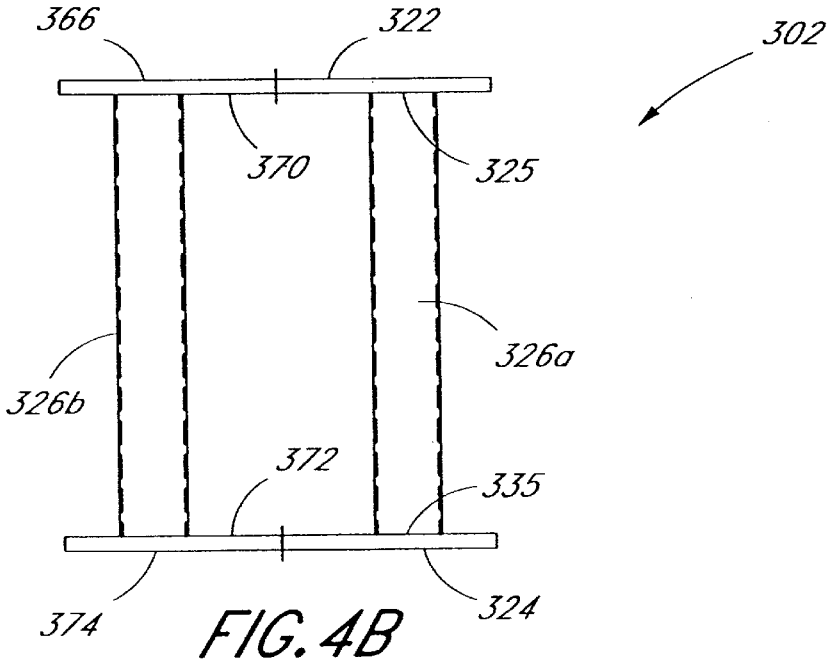
FIG. 4B is an isolated side view of the electric motor support frame of the low speed cooling fan assembly of FIG. 1.
Figure 4C:
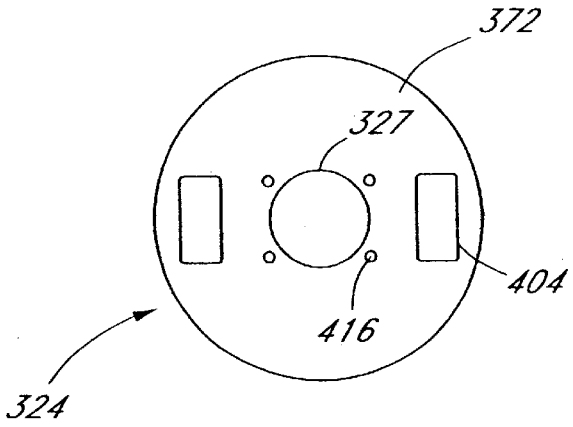
FIG. 4C is a plan view of the second support plate illustrating some of the structural components of the electric motor support frame of the low speed cooling fan assembly of FIG. 1.

Three separate views relating to the support frame 302 are shown in FIGS. 4A, 4B and 4C which further illustrates the components of the support frame 302. As shown by the plan view of the first support plate 322 in FIG. 4A, the plate 322 contains a plurality of mounting holes 400 that are used to attach the fan assembly 100 to a suitable overhanging structure. In this embodiment, the mounting holes are uniformly distributed about the plate 322 so that each hole 400 is proximally located at the midpoint between the center and the edge of plate 322.

The plate 322 further comprises a pair of rectangular regions 402 that defines a weld pattern between the plate 322 and the first end 325 of each of the pair of support beams 326*a*, 326*b* (FIG. 4B). As shown in FIG. 4A, the pair of rectangular regions 402 are aligned with each other and located distally from the center of the plate 322 with the center acting as the midpoint between the pair of rectangular regions 402.

As shown by the plan view of the second support plate 324 in FIG. 4C, the plate 324 contains a plurality of mounting holes 416 that are uniformly distributed so that each hole 416, in this embodiment, is approximately 67 mm from the center of plate 324. The mounting holes are used to secure the electric motor 304 to the plate 324. The opening 327 of the plate 324 is a centered circular hole having an approximate radius of 55 mm which, as discussed above, is adapted to receive the boss member 504 of the electric motor 304.

The plate 324 further comprises a pair of rectangular regions 404 that defines a weld pattern between the plate 324 and the second end 335 of each of the pair of support beams 326*a*, 326*b* (FIG. 4B). The pair of rectangular regions 404 are aligned with each other and located distally from the center of plate 324 with the center acting as the midpoint between the pair of rectangular regions 404.

Figure 5A:
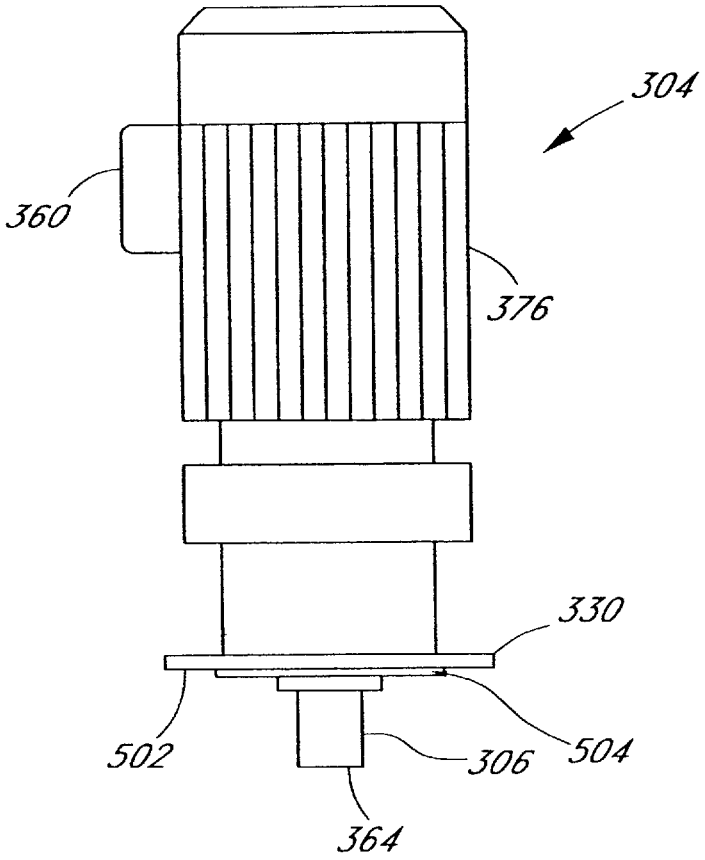
FIG. 5A is a side view of the electric motor of the low speed cooling fan assembly of FIG. 1.
Figure 5B:
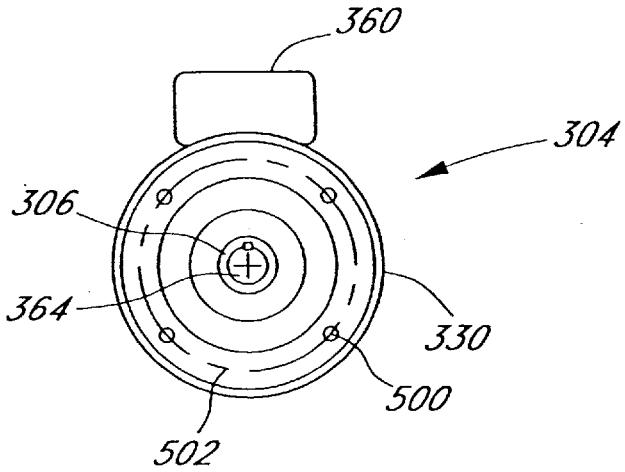
FIG. 5B is an axial view as seen by an observer looking directly down the axis of the shaft of the electric motor housing of the low speed cooling fan assembly of FIG. 1.

Reference will now be made to FIGS. 5A and 5B which include a side view of the electric motor 304 (FIG. 5A) and an end view of the electric motor 304 as seen by an observer looking toward the motor shaft 306 (FIG. 5B). In particular, FIGS. 5A and 5B both illustrate the boss member 504 that extends from the surface 502 of the mounting plate 330 so that the plane of the boss member 504 is parallel to the plane of the mounting plate 330. As mentioned previously, the boss member 504 is adapted to be flushly positioned within the opening 327 of the second support plate 324 of the support frame 302.

As shown in FIG. 5B, the mounting plate 330 of the electric motor 304 is adapted with a plurality of mounting holes 500 (FIG. 5B) that are uniformly distributed near the edge of the mounting plate 330. In particular, the mounting holes 500 are adapted to align with the mounting holes 416 of the plate 324 when the electric motor 304 is positioned within the support frame 302 as shown in FIG. 3A. Consequently, the electric motor 304 can be secured to the support frame 302 in the configuration of FIG. 3A by securing a plurality of standard fasteners through the holes 500 and 416 in a manner that is known in the art.

Figure 6:
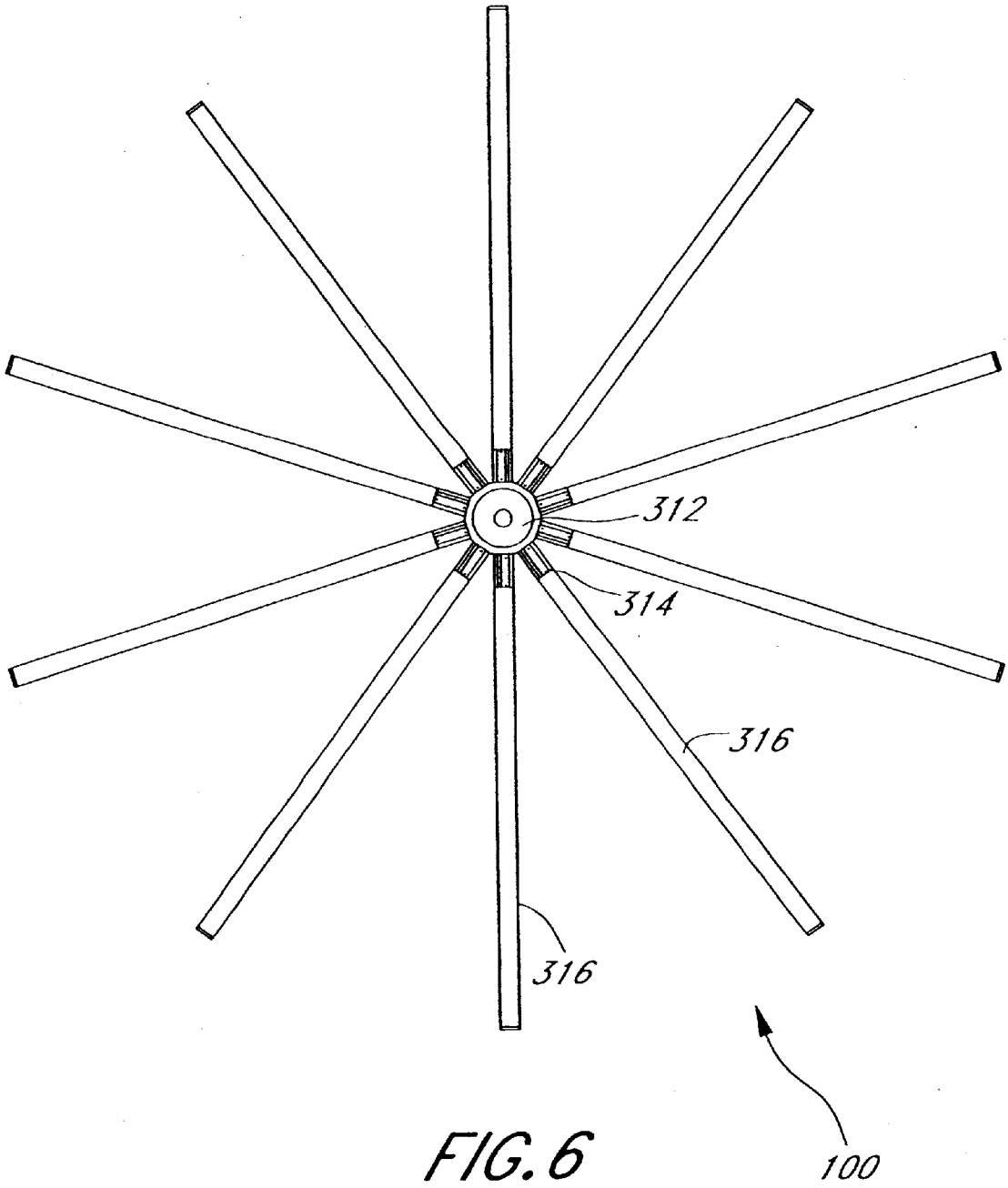
FIG. 6 is an axial view as seen by an observer looking up towards the low speed cooling fan assembly of FIG. 1.

FIG. 6 is a view of the fan assembly 100 as seen from below and illustrates the relationship between the hub 312, the set of blade supports 314 extending from the hub 312, and the set of fan blades 316 extending from the blade supports 314. Each fan blade 316 extends orthogonally from the rotational axis of the fan assembly 100 as defined by the motor shaft 306 in a manner that results in a uniform distribution of fan blades 316. In this embodiment, the set of fan blades 316 covers the set of blade supports 314 thus obscuring the view of the set of blade supports 314.

Figure 7:
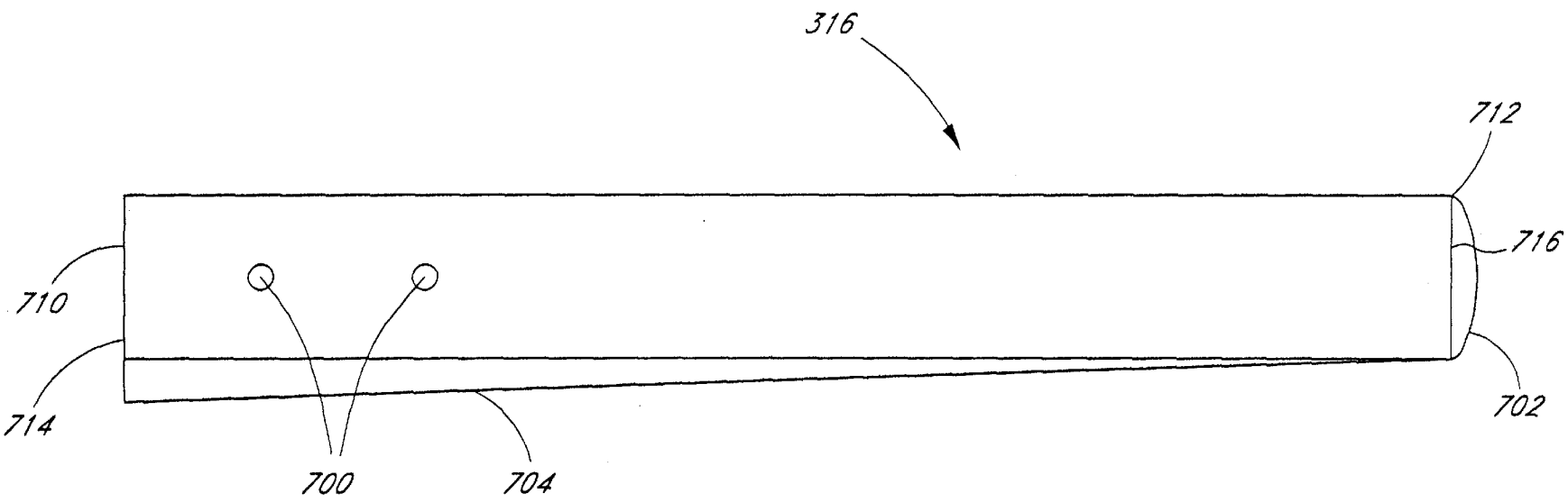
FIG. 7 is a plan view of an individual blade of the low speed cooling fan assembly of FIG. 1.

In the preferred embodiment, the diameter of the fan assembly 100 can be fabricated with a diameter ranging from 15 feet up to 40 feet and, more preferably, 20 to 40 feet. The fan blades 110 have a length of at least approximately 7.5 feet and, more preferably, at least approximately 10 feet. This results in the aspect ratio of each fan blade 316 to range between 15:1 up to 40:1 and, more preferably, 20:1 to 40:1. When the fan assembly 100 is operating under normal conditions, the drive ratio of the electric motor 304 is set so that the blade tip velocity is approximately 50 ft/sec. FIG. 7 shows a magnified view of a single fan blade 316 as viewed from below. In this embodiment, each fan blade 316 takes the form of a long narrow piece of aluminum with a hollow interior. Each fan blade 316 further contains a first opening 710 adjacent an inside edge 714 of the blade 316 and an second opening 712 adjacent an outside edge 716 of the blade 316. A plurality of mounting holes 700 that allow the securing of the fan blades 316 to the blade supports 314 of the hub 312 as described in a following section are located proximal to the first opening 710.

In this embodiment, the fan blades 316 are fabricated using a forced aluminum extrusion method of production. This allows lightweight fan blades with considerable structural integrity to be produced in an inexpensive manner. It also enables fan blades to be inexpensively fabricated with an airfoil shape. In this embodiment, each fan blades 316 is fabricated with a uniform cross-section along its length. However, additional embodiments could incorporate extruded aluminum fan blades with a non-uniform cross-section.

The aerodynamic qualities of the fan blade 316 are improved by mounting a tapered flap 704 to the fan blade 316 using standard fasteners. The flap 704 is essentially a lightweight long flat strip of rigid material with a tapered end. The flap 704 results in a more uniform airflow from the fan assembly 100 as is discussed in greater detail in a following section.

Using standard fasteners, a cap 702 is mounted inside the second opening 712 located at the second edge 716 of the fan blade 316, thus providing a continuous exterior surface proximal to the second edge 716. In one embodiment, the cap comprises a minimal structure that essentially matches the cross-sectional area of the fan blade 316. In other embodiments, the cap further comprises additional aerodynamic structures such as a spill plate. In other embodiments, the cap is adapted to attach additional structural support members such as a circular ring around the circumference of the fan assembly 100.

A magnified view of the inner side of the hub 312 as seen along a line that is parallel to the shaft 306 is shown in FIG.

Figure 8:
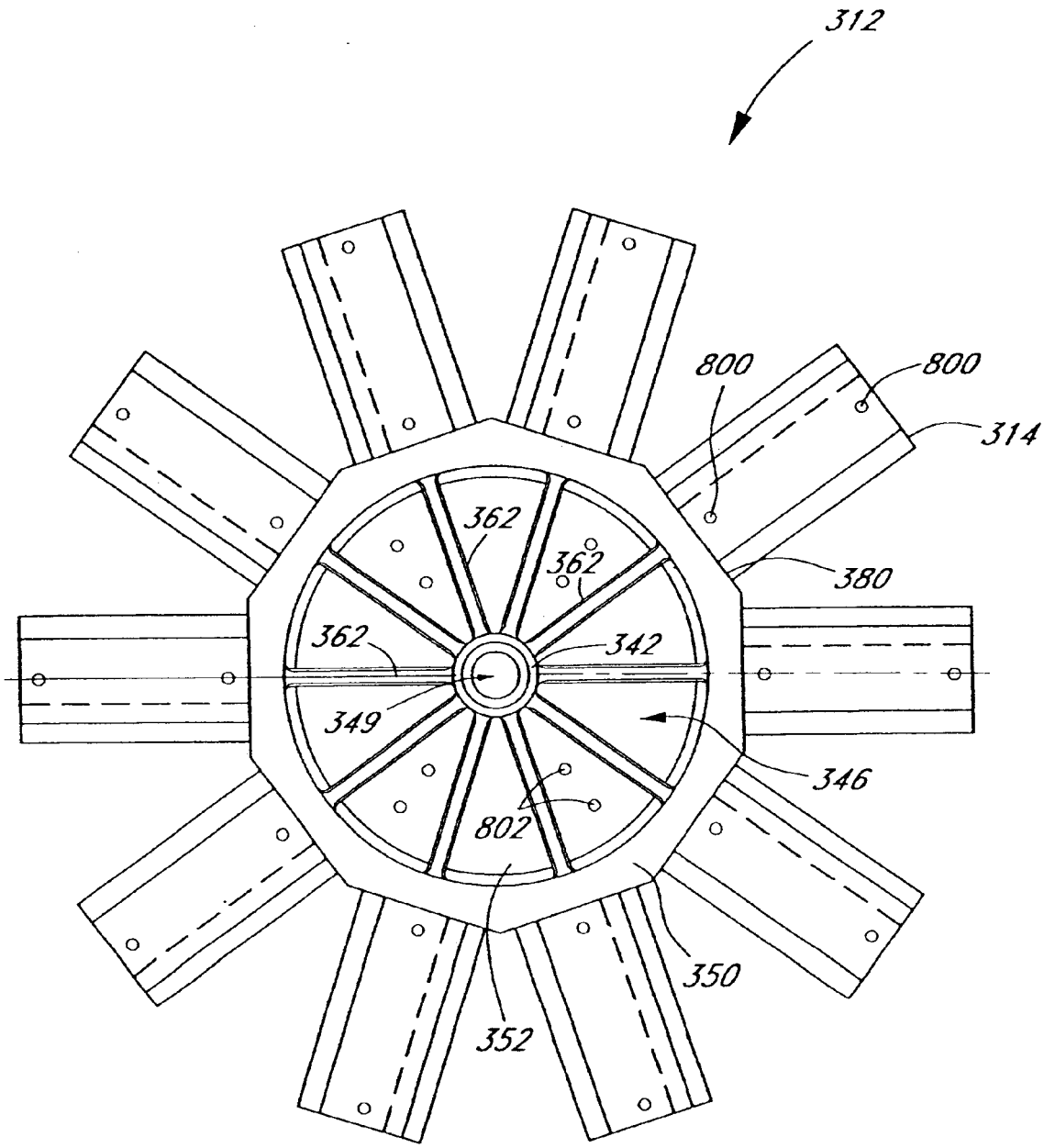
FIG. 8 is a plan view of the hub of the low speed cooling fan assembly of FIG. 1.

8. The plurality of ribs 362 are shown extending from the flange section 342 to the polygonal rim section 350. Each rib 362 is also shown joining the rim section 350 at the midline of the blade support 314. Each rib 362 is intended to inhibit the large force applied by the corresponding fan blade 316 onto the hub 312 from compromising the structural integrity of the hub 312. As shown in FIG. 8, the number of planar surfaces that comprises the outer surface 380 of the polygonal rim section 350 equals the number of blade supports 314 that radially extend outward from the outer surface 380 of the rim section 350 of the hub 312. This arrangement provides a perpendicular relationship between each blade support 314 and each adjacent outer surface 380, thus enabling the fan blades 316 to be flushly mounted to the outer surface 380 of the hub 312 in a manner which is described in greater detail below. In this embodiment, the hub 312 comprises a total of ten blade supports, ten outer surfaces 340 and ten ribs 362.

The hub 312 further comprises a first plurality of mounting holes 800 that are located along the midline of each blade support 314. The plurality of holes 800 are used in conjunction with standard fasteners to secure the plurality of fan blades 316 to the plurality of blade supports 314. Each fan blade 316 is mounted to the hub 312 by fitting the inside opening 710 of the fan blade 316 around a corresponding blade support 314 so that the inside edge 714 of the fan blade 316 is flushly mounted adjacent to the outer surface 380 of the rim section 350 of the hub 312. Each fan blade 316 is secured to a blade support 314 using the mounting holes 700 in conjunction with the set of mounting holes 800 of the blade support 314 and a set of standard fasteners in a manner that is known in the art.

The hub 312 further comprises a second plurality of mounting holes 802. The second plurality of mounting holes 802 are symmetrically distributed in a radial pattern on the central section 346 of the hub 312. The holes 802 are used in conjunction the safety retainer bolts 340 to secure the safety retainers 320 to the hub 312 in a manner which is known in the art.

Figure 9:
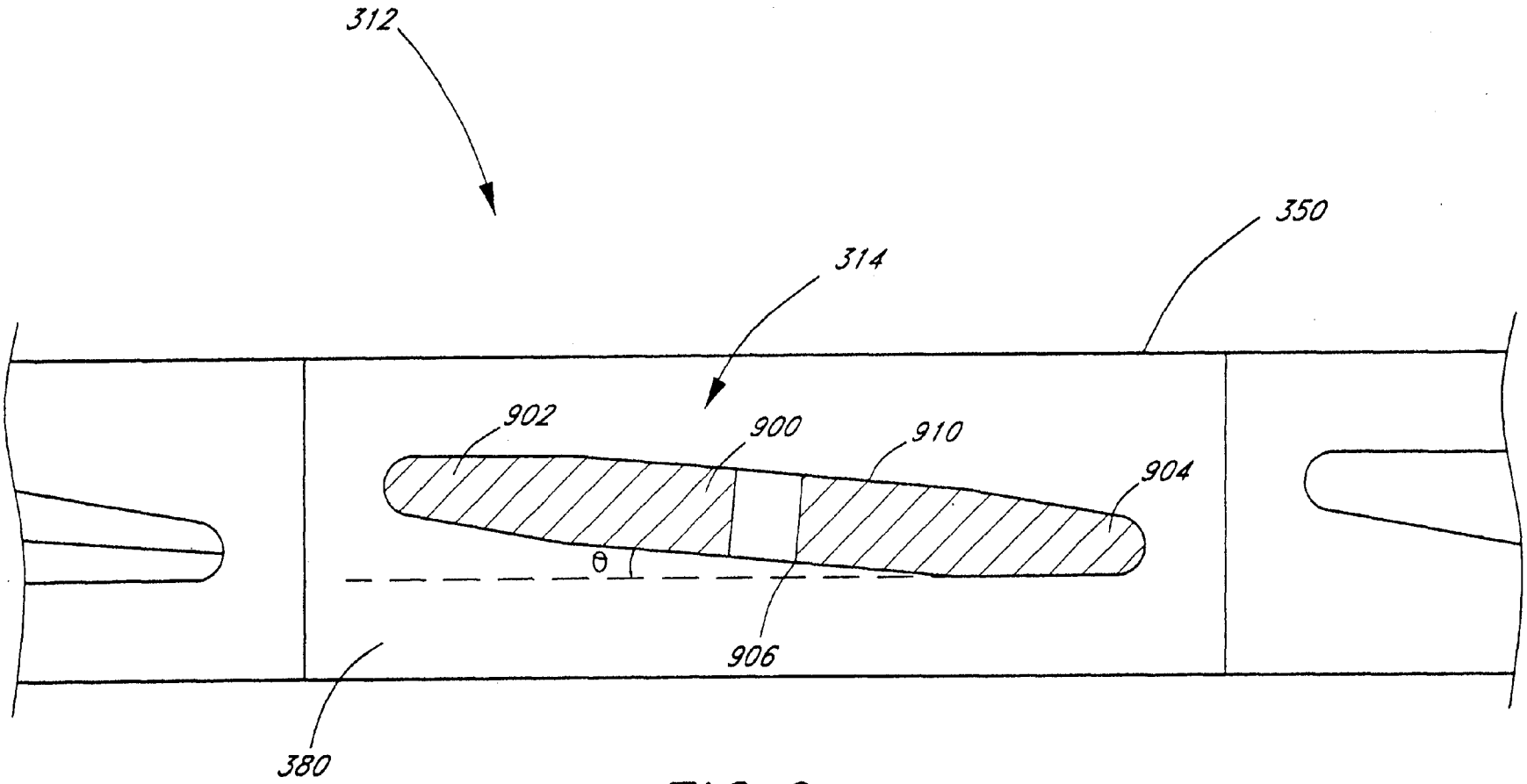
FIG. 9 is a cross-sectional view of a single blade support of the low speed cooling fan assembly of FIG. 1.

A magnified cross-sectional view of a single blade support 314 is shown in FIG. 9 as seen by an observer looking along the plane of the central section 346 of the hub 312 toward the center of the hub 312 with the fan blades 316 removed. Each blade support 314 is essentially a paddle-like structure that extends in a perpendicular manner from the outer surface 380 of the polygonal rim section 350. Furthermore, each blade support 314 is tilted out of the plane of the hub 312 in a manner which is described below.

Each blade support 314 comprised of a broad central section 900 located between an elevated tapered section 902 and a lower tapered section 904, is tilted out of the plane of the central section 346 of the hub 312 by an angle theta. In this case, theta is defined as the angle between the intersection of a lower surface 906 of the central section 900 and the adjacent surface 380 of the polygonal rim section 350 and the a line parallel to both the plane of the central section 346 of the hub 312 and the adjacent surface 380. This allows the fan blades 316 to be mounted with a corresponding angle of attack equal to theta. In one embodiment, the angle theta is equal to eight degrees for all blade supports 314. When the fan assembly 100 is rotating, the blade support 314 shown in FIG. 9 would appear to travel with the elevated section 902 leading the lowered section 904.

The central section 900 of each blade support 314 is essentially rectangular in shape and thus bound by the lower surface 906 as well as a parallel upper surface 910. The rectangular shape of the central section 900 provides an effective mounting structure for the fan blades 314 as is described in greater detail below.

Figure 10:
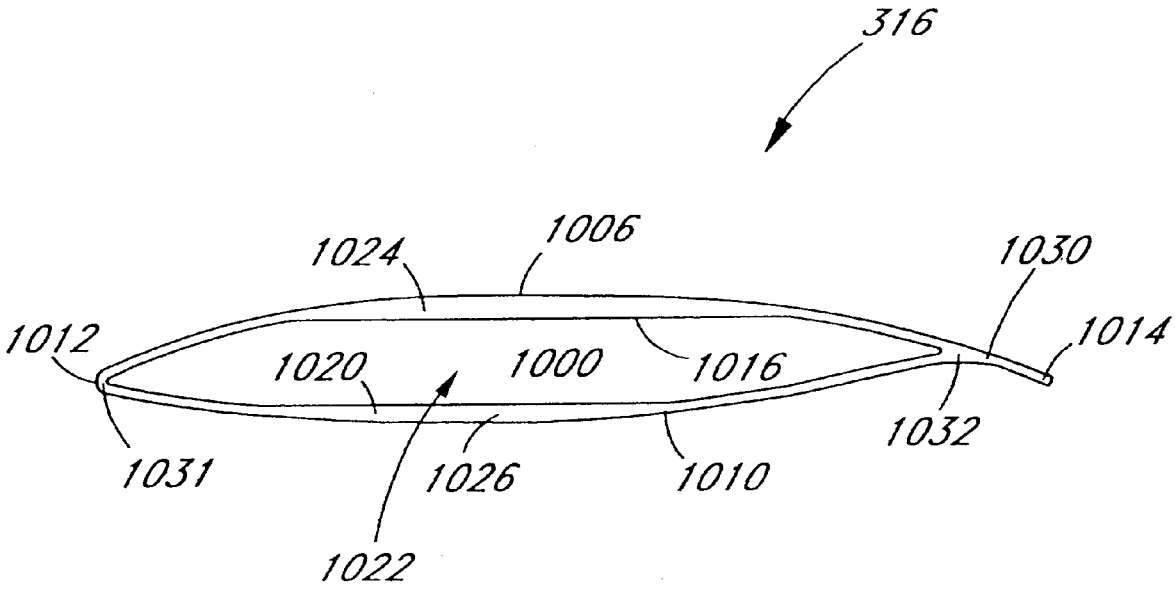
FIG. 10 is a cross-sectional view of an individual blade illustrating the cross-sectional shape of a single fan blade of the low speed cooling fan assembly of FIG. 1.

FIG. 10 shows a cross-sectional view of the fan blade 316 at an arbitrary location along its length as seen by an observer looking towards the second opening 712. The fan blade is comprised of a first curved wall 1024, a second curved wall 1026, and a cavity region 1022 formed therefrom. The two walls 1024 and 1026 are joined together at leading junction 1031 and a trailing junction 1032. At the trailing junction 1032, the two walls 1024 and 1026 combine in a continuous manner to form a third wall 1030. The third wall 1030 continues until it reaches a trailing edge 1014. A first surface 1006 is formed at the exterior of wall 1024 and continues in a seamless manner to the exterior of wall 1030 until the trailing edge 1014 is reached. A second surface 1010 is formed at the exterior of wall 1026 and continues in a seamless manner to the exterior of wall 1030 until the trailing edge is reached. The two surfaces 1006 and 1010 meet at a leading edge 1012. The cavity region 1022 is comprised mainly of a rectangularly-shaped broad central section 1000. A planar third surface 1016 is formed at the interior of wall 1024 in the region of section 1000 and a planer fourth surface 1020 is formed at the interior of wall 1030 in the region of section 1000. Consequently, both of the planar interior surfaces 1016 and 1020 are parallel to each other.

Each fan blade 316 is adapted so that the shape of the broad central section 1000 in the interior of the fan blade 316 precisely matches the shape of the corresponding central section 900 of the blade support 314. Consequently, when the fan blade 316 is positioned around its corresponding blade support 314 and attached with a plurality of fasteners, a secure fit will be realized. Moreover, since flat surfaces are easier to manufacture than curved surfaces, this method of attachment is cost effective.

The two exterior surfaces 1006 and 1010 are adapted to form an airfoil shape. In one embodiment, the airfoil shape is based on the shape of a German sail plane wing having a reference number FX 62-K-131. Due to structural limitations associated with the extruded manufacturing process, it is difficult to exactly match the shape of the fan blade 316 to an optimal airfoil shape. In particular, it is difficult to extend the third wall 1030 to match the preferred airfoil shape. When the flap 704 is mounted to the third wall 1030 along the trailing edge 1014 in a smooth and continuous manner, it essentially acts as an extension to the third wall 1030, thus matching the airfoil shape more closely.

If the flap 704 (FIG. 7) is tapered so that it is wide near the inside edge 714 and narrow near the outside edge 716, then an improved design can be realized. By tapering the flap 704, the shape of the blade becomes increasingly optimal at decreasing radii. The foregoing relationship acts to compensate for the decreasing blade speed at decreasing radii, thus resulting in a more uniform airflow across the entire fan assembly 100.

Figure 11:
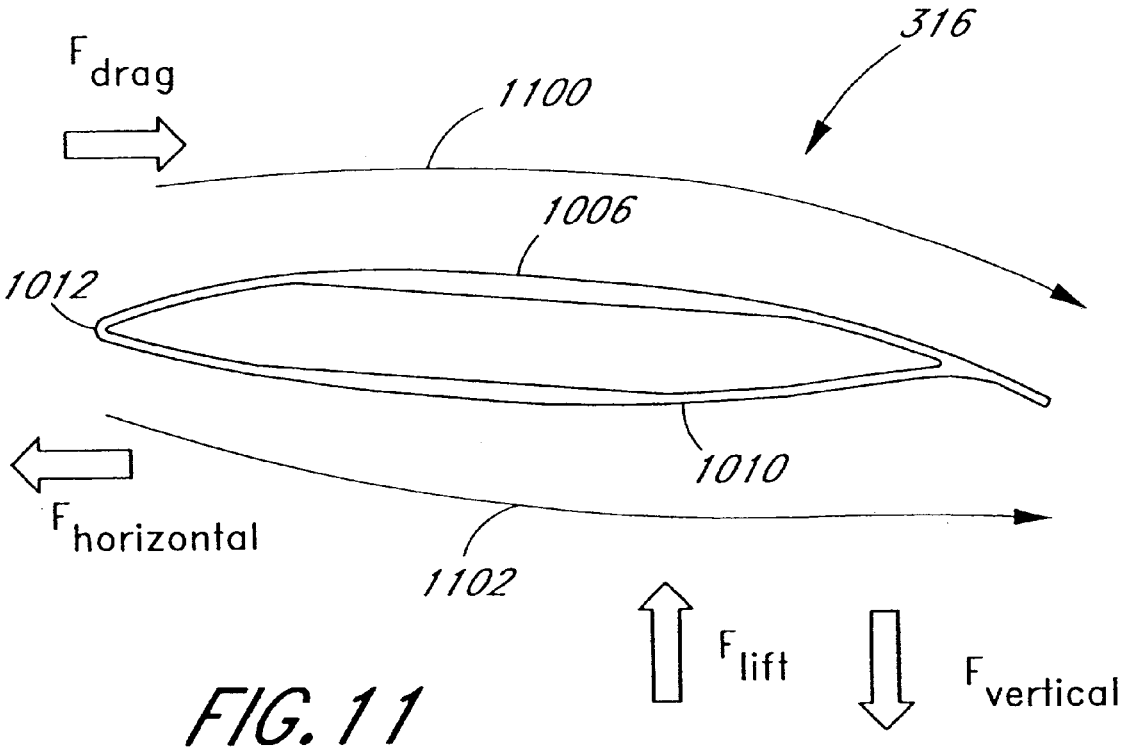
FIG. 11 is a cross-sectional view of an single fan blade illustrating the aerodynamic forces created by the low speed cooling fan assembly of FIG. 1.

When the fan assembly 100 is in an operating mode, the cross-sectional image of the fan blade 316 shown in FIG. 11 tilted by a corresponding angle of attack in a clockwise manner would appear to travel with the leading edge 1012 in front. According to an observer fixed to an individual fan blade 316, the motion of the fan blade 316 causes air currents 1100 and 1102 along the surfaces 1006 and 1010 of the fan blade 316 respectively. The airfoil shape of each fan blade 316 causes the velocity of the upper air current 1034 to be greater than the velocity of the lower air current 1036.

Consequently, the air pressure at the lower surface 1010 is greater than the air pressure at the upper surface 1006.

The apparent asymmetric airflows produced by the rotation of the fan blades 316 results an upward lift force $F_{vertical}$ to be experienced by each fan blade 316. A reactive downward force $F_{vertcal}$ is therefore applied to the surrounding air by each fan blade 316. Moreover, the airfoil shape of the fan blade 316 minimizes a horizontal drag force $F_{drag}$ acting on each fan blade 316, therefore resulting in a minimum horizontal force $F_{horizontal}$ being applied to the surrounding air by each fan blade 316. Consequently, the airflow created by the fan assembly 100 approximates a columnar flow of air along the axis of rotation of the fan assembly 100.

In the preferred embodiment, the fan assembly 100 is capable of producing a mild columnar airflow with a 20 foot diameter. The columnar nature of this airflow combined with its large inertial mass allow the airflow to span large spaces. Therefore, the fan assembly 100 is able to provide wide ranging mild circulatory airflows that serve to cool individuals in large warehouse environments. In the preferred embodiment, the foregoing capabilities are achieved at a remarkably low power consumption rate of only 370 Watts per 10,000 square feet of building space.

In repeated experiments using a prototype version of the fan assembly 100, measurements of air speed were made by the Applicant. The prototype version of the fan assembly 100 had an outer diameter, measured from outside edge 716 to outside edge 716 of each opposing pair of fan blades 316, equal to 20 feet and was comprised of 10 fan blades. The averages of multiple sets of individual air speed measurements obtained at locations 10 feet downwind from the fan blades 316 ranged from 3 up to 5 miles per hour. The maximum air speed measured at locations two feet downwind from the fan blades 316 was found to be no greater than 6 miles per hour.

Throughout the trials performed by the Applicant, the velocity of the outside edge 716 of the fan blades 316 was maintained at 36 miles per hour while the electric motor 304 consumed a mere 370 Watts of power. A columnar airflow with a diameter of 20 feet was generated which was sufficient to provide cooling throughout a 10,000 square foot warehouse that contained the fan assembly 100.

The technical difficulties involved in designing the fan assembly 100 have been overcome by incorporating innovative design features. In particular, the large fan blades 316 are manufactured using an extruded aluminum technique. This method results in fan blades 316 that are sturdy, lightweight and inexpensive to manufacture. This method also enables the fan blades 316 to be fabricated with an airfoil shape which enables a columnar airflow to be generated. Furthermore, the electric motor 304 used in the fan assembly 100 is a compact unit that contains a built-in gear reduction mechanism that enables the electric motor 304 to produce the large torque required by the large fan assembly 100. The electric motor 304 is also a controllable device that is capable of producing a gentle torque at startup thereby reducing mechanical stress within the fan assembly 100. In addition, the electric motor 304 also provides a reduced steady torque for reduced speed operation. Moreover, the safety aspects of the fan assembly 100 have been enhanced by including a plurality of safety retainers 320 that are designed to support the hub 312 along with the plurality of fan blades 316 in the event that the hub 312 becomes disengaged from the fan assembly 100.

Although the preferred embodiment of the present invention has shown, described and pointed out the fundamental novel features of the invention as applied to this embodiment, it will be understood that various omissions, substitutions and changes in the form of the detail of the device illustrated may be made by those skilled in the art without departing from the spirit of the present invention. Consequently, the scope of the invention should not be limited to the foregoing description, but should be defined by the appending claims.

What is claimed is:

1. A method of cooling individuals in an industrial building, the method comprising:

mounting a fan having a hub and a plurality of air foil blades with a substantially uniform cross-section of at least approximately 10 to 12 feet in length extending radially outward from the hub to a ceiling of the industrial building;

rotating the fan so that the radially extending blades produce a moving column of air that is approximately 20 to 24 feet in diameter at a position adjacent the fan, wherein the rotation of the fan imparts a columnar air flow having velocity of approximately 3 to 5 miles per hour at a distance of 10 feet from the fan so that the fan entrains a volume of air to flow in a pattern throughout the industrial building so that the entrained air in the pattern disrupts the boundary layer of air adjacent the individual so as to facilitate evaporation of sweat from the individuals.

2. The method of claim 1, wherein the step of mounting the fan comprises mounting a plurality of fans having a plurality of blades of approximately 10 feet in length to the ceiling of the industrial building wherein the ratio of such fans per square foot of building is approximately 1 fan per 10,000 square feet.

3. The method of claim 2, wherein the step of mounting the fan comprises mounting a plurality of fans each having ten blades.

4. The method of claim 1, wherein the step of mounting the fan comprises mounting a fan with a plurality of blades that are fabricated using an aluminum extrusion technique.

5. The method of claim 4, wherein the step of mounting the fan comprises mounting a fan with a plurality of blades that are fabricated with a uniform cross-section.

6. The method of claim 1, wherein the step of mounting the fan comprises mounting a fan with a plurality of blades each having a first surface and a second surface.

7. The method of claim 6, wherein the step of mounting the fan comprises mounting a fan with a plurality of blades each having a first surface and a second surface that combine to form an airfoil shape so as to enhance the columnar properties of the airflow produced by the fan.

8. The method of claim 7, wherein the step of mounting the fan comprises mounting a plurality of flaps each having a third and fourth surface to the plurality of blades so as to extend the area of the first and second surface of each blade in a manner that results in an improved airfoil design.

9. The method of claim 8, wherein the step of mounting the fan comprises mounting a plurality of flaps each having a tapered profile that results in an airfoil design that becomes more optimal at locations that are closer to the axis of rotation of the fan so as to compensate for the decreasing blade speed at locations that are closer to the axis of rotation of the fan so as to improve the uniformity of the airflow pattern produced by the fan.

10. The method of claim 1 wherein the step of mounting the fan comprises mounting a fan with a plurality of blades that extend from the axis of rotation of the fan in a perpendicular manner with an angle of attack equal to eight degrees.

11. The method of claim 1 wherein the step of mounting the fan comprises mounting a fan with a plurality of blades with a secondary attachment means that is intended to support the plurality of blades in the event that the primary attachment malfunctions.

12. The method of claim 1, wherein the step of rotating the fan so as to entrain the volume of air to flow in the pattern comprises entraining the air to flow in a column generally downward towards the floor of the building and then to travel laterally outward from the column.

13. The method of claim 1, wherein the step of rotating the fan so as to entrain the volume of air to flow in the pattern comprises entraining the air to flow in a column generally downward towards the floor of the building and then to travel laterally outward from the column toward a plurality of walls and then to travel upward toward a ceiling and then to travel laterally inward toward the fan.

14. The method of claim 1, wherein the step of rotating the fan so as to entrain the volume of air to flow in the pattern comprises rotating the fan such that the ratio of the velocity of the air in units of feet per minute at a distance of approximately ten feet from the blades to the rotational speed of the fan in units of rotations per minute is between the approximate range of 5 to 1 and 9 to 150 that a moving volume of air is entrained in flow in a circulating pattern throughout the industrial building to thereby disrupt the boundary layer of air adjacent the individuals so as to facilitate evaporation of sweat from the individuals.

* * * * *